US008472836B2

(12) United States Patent
Nomi

(10) Patent No.: US 8,472,836 B2
(45) Date of Patent: Jun. 25, 2013

(54) COVER OPENING/CLOSING UNIT AND IMAGE FORMING APPARATUS

(75) Inventor: Ryotaro Nomi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 439 days.

(21) Appl. No.: 12/874,272

(22) Filed: Sep. 2, 2010

(65) Prior Publication Data

US 2011/0229191 A1 Sep. 22, 2011

(30) Foreign Application Priority Data

Mar. 17, 2010 (JP) ..... 2010-060264

(51) Int. Cl.
*G03G 21/16* (2006.01)

(52) U.S. Cl.
USPC ..... 399/110; 399/114; 399/124; 49/399

(58) Field of Classification Search
USPC ..... 399/110, 114, 124; 49/399
See application file for complete search history.

(56) References Cited

FOREIGN PATENT DOCUMENTS

JP 2001-235993 A 8/2001

*Primary Examiner* — Walter L Lindsay, Jr.
*Assistant Examiner* — Ruth Labombard
(74) *Attorney, Agent, or Firm* — Sughrue Mion, PLLC

(57) ABSTRACT

A cover opening/closing unit includes a cover body, a plurality of first hinge portions, a handle portion, and a second hinge portion. The cover body is attached to a side surface of an apparatus body. The first hinge portions are provided on both ends of a lower end portion of the cover body so as to rotatably support the cover body. The handle portion is provided between the first hinge portions. The second hinge portion is provided on a back of the cover body and between the first hinge portions so as to rotatably support the cover body.

11 Claims, 8 Drawing Sheets

COVER OPENING/CLOSING UNIT AND IMAGE FORMING APPARATUS

CROSS-REFERENCE TO RELATED APPLICATIONS

This application is based upon and claims priority under 35 USC 119 from Japanese Patent Application No. 2010-060264, filed Mar. 17, 2010.

BACKGROUND

Technical Field

The present invention relates to a cover opening/closing unit and an image forming apparatus provided with the cover opening/closing unit.

SUMMARY OF THE INVENTION

According to an aspect of the invention, a cover opening/closing unit includes a cover body, a plurality of first hinge portions, a handle portion, and a second hinge portion. The cover body is attached to a side surface of an apparatus body. The first hinge portions are provided on both ends of a lower end portion of the cover body so as to rotatably support the cover body. The handle portion is provided between the first hinge portions. The second hinge portion is provided on a back of the cover body and between the first hinge portions so as to rotatably support the cover body.

BRIEF DESCRIPTION OF THE DRAWINGS

Exemplary embodiments of the invention will be described in detail based on the following figures, wherein.

DETAILED DESCRIPTION

An exemplary embodiment of the invention will be described below with reference to the drawings.

(1) Fundamental Configuration and Operation of Printer

First, the fundamental configuration and operation of a printer (image forming apparatus) according to an exemplary embodiment will be described.

Figure 1:
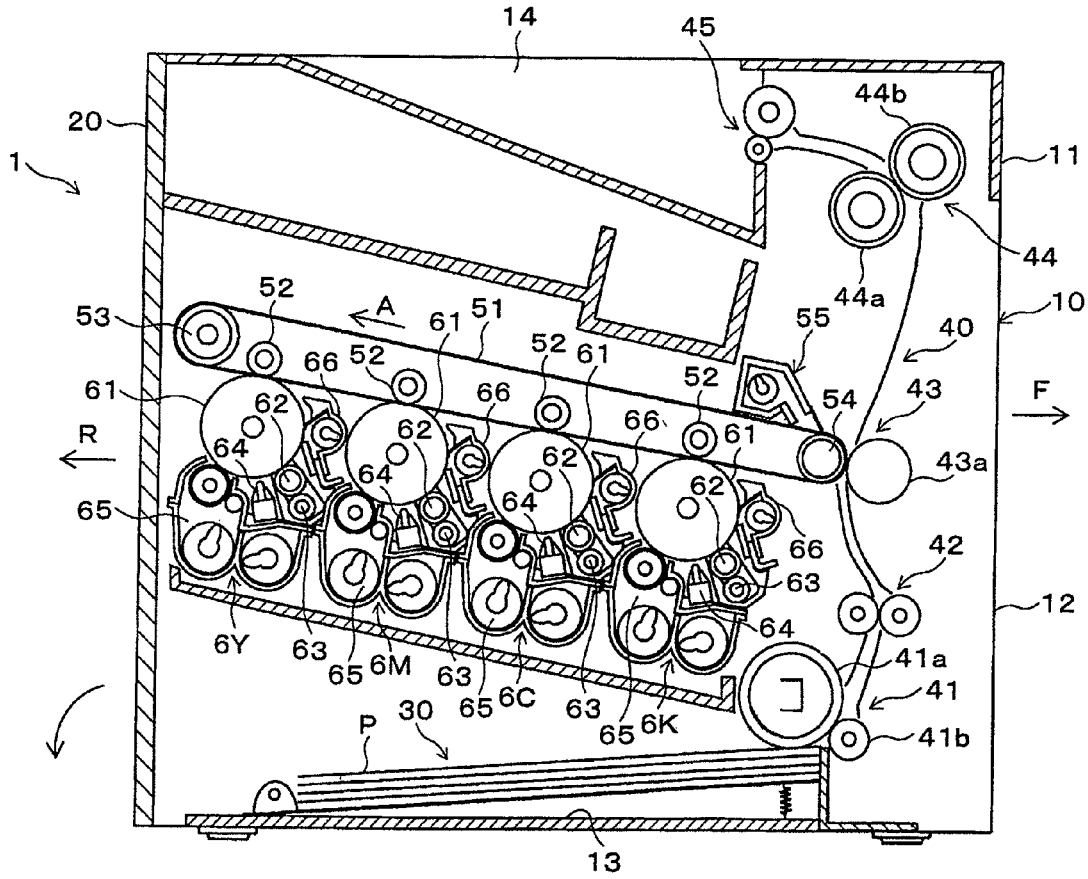
FIG. 1 is a side sectional view showing a printer according to an exemplary embodiment.

FIG. 1 shows an internal configuration of a printer 1 according to an exemplary embodiment. In FIG. 1, the reference numeral 10 represents an apparatus body having a housing 11. A rear surface of the apparatus body 10 is closed by a rear cover 20, and a front surface thereof is closed by a front cover 12. In addition, one side surface (which is the surface shown in FIG. 1) of the apparatus body 10 is opened/closed by a side cover 70 which will be described later. Front, rear, upper and lower directions in the following description mean directions in the apparatus body 10 on the assumption that the direction R is a rear direction and the direction F is a front direction in FIG. 1.

A sheet feed tray 30 is provided in a bottom portion of the apparatus body 10. Sheets P are extracted sequentially one by one from the top sheet to the front by a sheet extracting portion 41. Each extracted sheet P is moved up in a sheet conveyance path 40 formed on the front side of the apparatus body 10, and outputted to an output tray 14 formed on the top of the apparatus body 10.

The printer 1 is a tandem type full color printer, in which a transfer belt 51 and image forming units 6Y, 6M, 6C and 6K of four colors, a secondary transfer portion 43, a fixing portion 44, etc. are built in the apparatus body 10. The transfer belt 51 is stretched rotatably and at a tilt to rise from the front to the rear (to rise from the right to the left in FIG. 1) so as to rotate in a direction indicated by an arrow A. The image forming units 6Y, 6M, 6C and 6K are arranged in parallel under the transfer belt 51. The image forming units 6Y, 6M, 6C and 6K are arrayed in parallel with the tilt direction of the transfer belt 51.

The four image forming units 6Y, 6M, 6C and 6K form toner images of yellow (Y), magenta (M), cyan (C) and black (K), and have the same fundamental configuration. Each image forming unit 6Y, 6M, 6C, 6K has a photoconductor drum 61, a charging roller 62 and a charging roller cleaner 63 disposed around the photoconductor drum 61, an image exposure unit 64, a developing unit 65 and a photoconductor drum cleaner 66.

Color image information is inputted to the printer 1 from a personal computer or the like. When the color image information is inputted, four light beams corresponding to the respective colors are emitted from the image exposure units 64. The surfaces of the rotating photoconductor drums 61 which have been charged by the charging rollers 62 are scanned with those light beams respectively. Thus, electrostatic latent images of the respective colors are formed on the surfaces of the photoconductor drums 61 respectively.

The electrostatic latent images formed on the photoconductor drums 61 are developed with developing agents including toners of the respective colors by the developing units 65 respectively. The developed toner images (color images) are primarily transferred to the surface (outer circumferential surface) of the rotating transfer belt 51 by primary transfer rollers 52 respectively. The primary transfer operations for transferring the developed toner images from the photoconductor drums 61 to the transfer belt 51 are performed sequentially at predetermined timing in the image forming units 6Y, 6M, 6C and 6K. As soon as the transfer belt 51 passes through the black image forming unit 6K located on the most downstream side, a full color toner image is formed on the surface of the transfer belt 51.

Residues such as toner, discharge products, etc. may adhere to the surface of each photoconductor drum 61 after the primary transfer. The residues are removed by the photoconductor drum cleaner 66. The surface of the photoconductor drum 61 is charged again by the charging roller 62. Residues which cannot be removed by the photoconductor drum cleaner 66 but still adhere to the charging roller 62 are removed by the charging roller cleaner 63 which rotates in contact with the charging roller 62.

The transfer belt 51 is wound around a driving roller 53 and a backup roller 54. When the driving roller 53 rotates, the transfer belt 51 rotates in the direction indicated by the arrow A. Inside the transfer belt 51, primary transfer rollers 52 are disposed. Each primary transfer roller 52 forms a nip with the photoconductor drum 61 of the image forming unit 6Y, 6M, 6C, 6K so that the transfer belt 51 can be put between the primary transfer roller 52 and the photoconductor drum 61 of the image forming unit 6Y, 6M, 6C, 6K in the nip.

The full color toner image formed on the transfer belt 51 is transferred to the sheet P in the secondary transfer portion 43, after the sheet P is extracted from the sheet feed tray 30 by the sheet extracting portion 41 and rises through the sheet conveyance path 40 at a proper timing. The sheet extracting portion 41 has a sheet feed roller 41*a* and a sheet separating roller 41*b*. One sheet P separated from another by the sheet extracting portion 41 and extracted to the front is once conveyed to a registration roller pair 42 located above the sheet extracting portion 41, and stopped in the registration roller pair 42. The sheet P is sent out to the secondary transfer portion 43 by the registration roller pair 42 rotationally driven at a predetermined timing.

The secondary transfer portion 43 is constituted by the backup roller 54 which stretches the transfer belt 51, and a secondary transfer roller 43*a* which forms a nip with the backup roller 54. When the sheet P passes between the rollers 54 and 43*a*, the full color toner image on the transfer belt 51 is transferred to the sheet P. Residues such as toner etc. may adhere to the surface of the transfer belt 51 after the secondary transfer. The residues are removed by a transfer belt cleaner 55 which is disposed above the front end portion of the transfer belt 51.

The sheet P on which the full color toner image has been transferred passes through the fixing portion 44 so that the full color toner image is fixed to the sheet P by the fixing portion 44. The fixing portion 44 has a heating roller 44*a* and a pressure roller 44*b* which forms a nip with the heating roller 44*a*. When the sheet P passes between the rollers 44*a* and 44*b*, the full color toner image is fixed to the sheet P by the effect of pressure contact and heating. The sheet P which has passed through the fixing portion 44 is outputted to the output tray 14 by an output roller pair 45. The sheet conveyance path 40 is constituted by a path ranging from the sheet extracting portion 41 to the output roller pair 45 through the registration roller pair 42, the secondary transfer portion 43 and the fixing portion 44.

(2) Configuration of Side Cover Opening/Closing Mechanism

Figure 2:
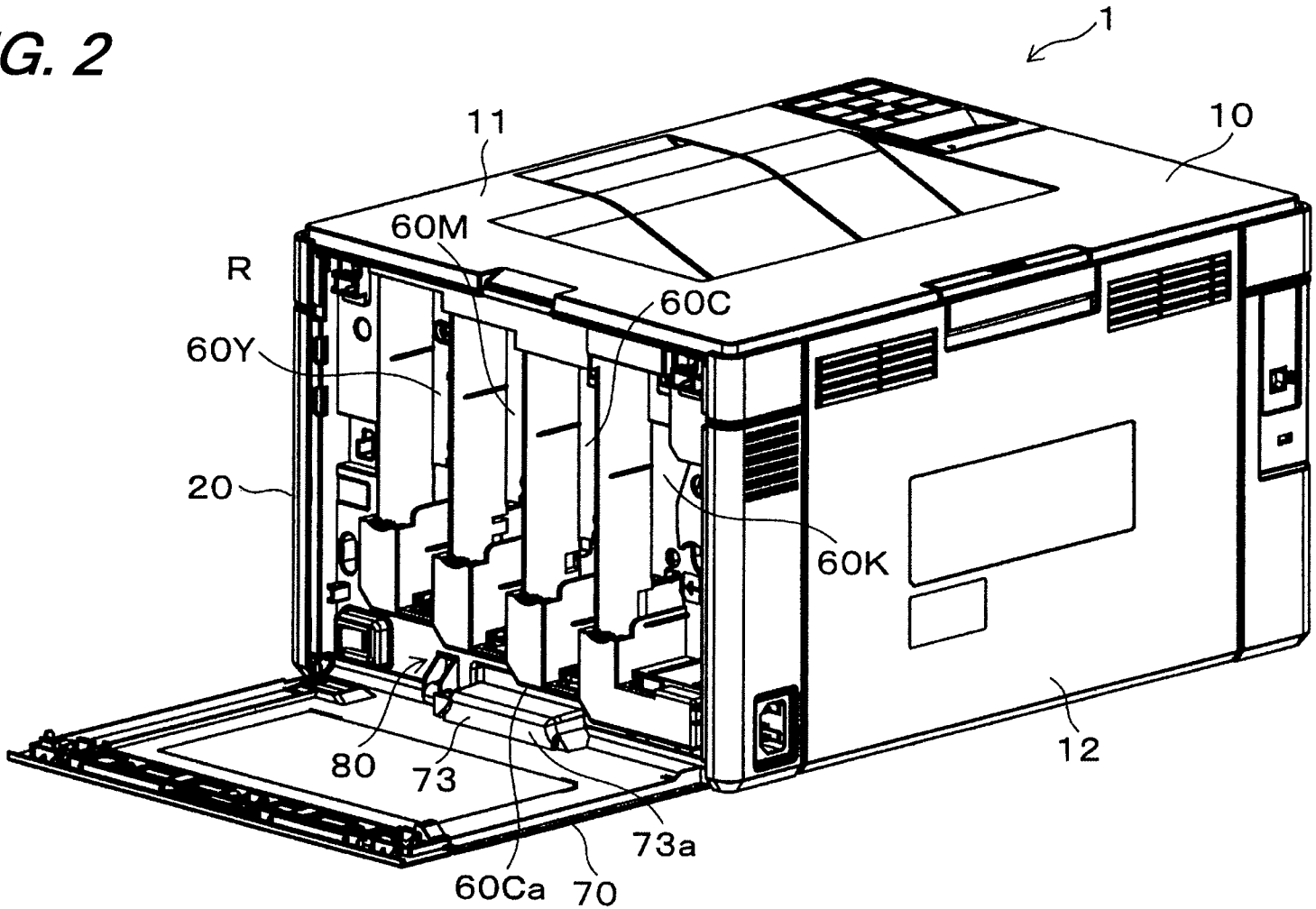
FIG. 2 is a perspective view showing the printer according to the exemplary embodiment.
Figure 3:
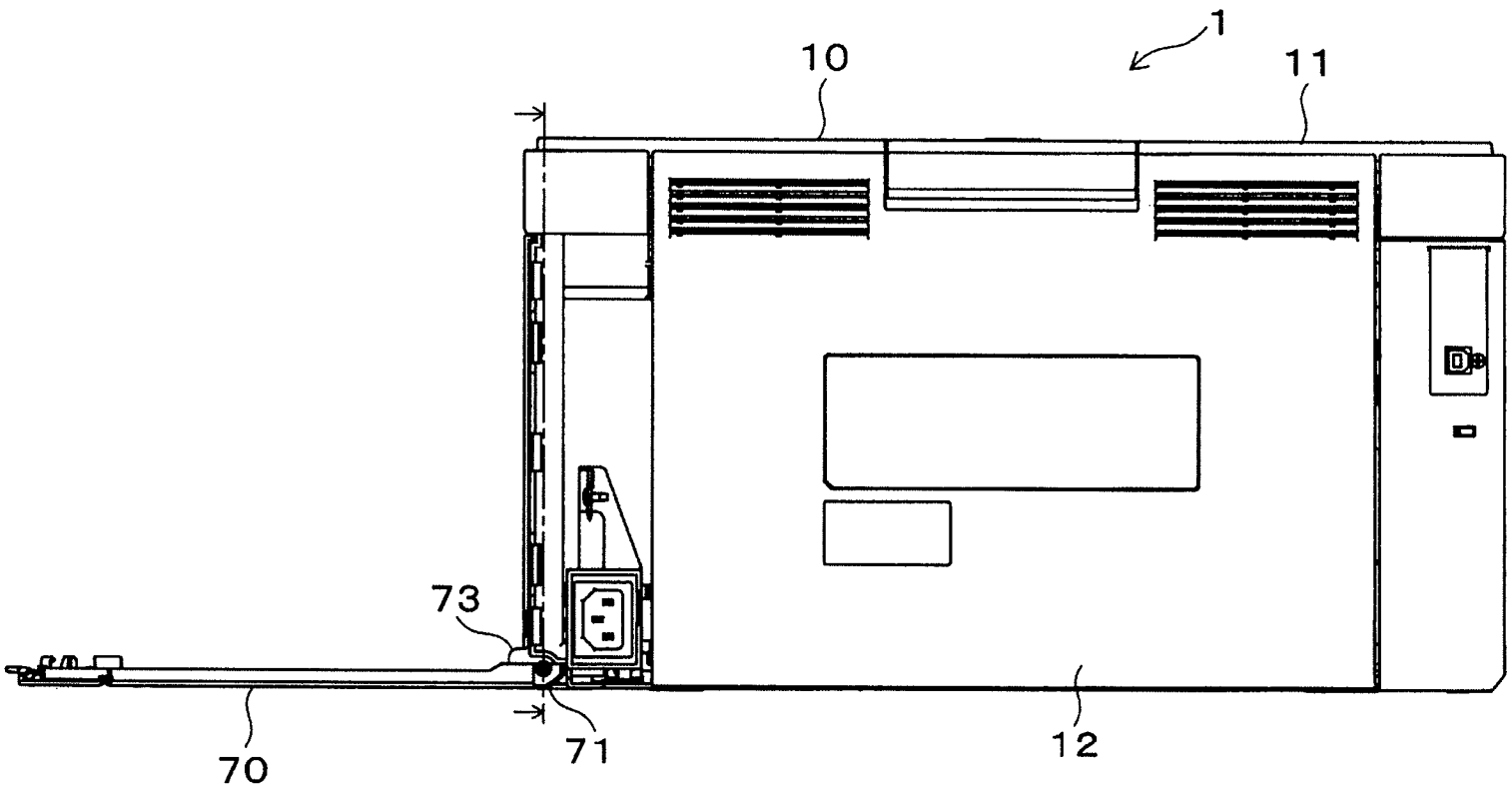
FIG. 3 is a front view showing the printer according to the exemplary embodiment, in which a cover is opened.

The printer 1 according to this exemplary embodiment has a side cover (cover body) 70 in addition to the rear cover 20. The configuration of a mechanism for opening/closing the side cover 70 will be described below with reference to FIGS. 2 to 8. As shown in FIG. 2, a side portion of the printer 1 is opened/closed by the side cover 70. Toner cartridge receiving portions 60Y, 60M, 60C and 60K for receiving toner cartridges (not shown) filled with toners of yellow (Y), magenta (M), cyan (C) and black (K) respectively are provided in parallel in the side portion of the printer 1. When the side cover 70 is opened, any toner cartridge can be replaced.

Figure 4:
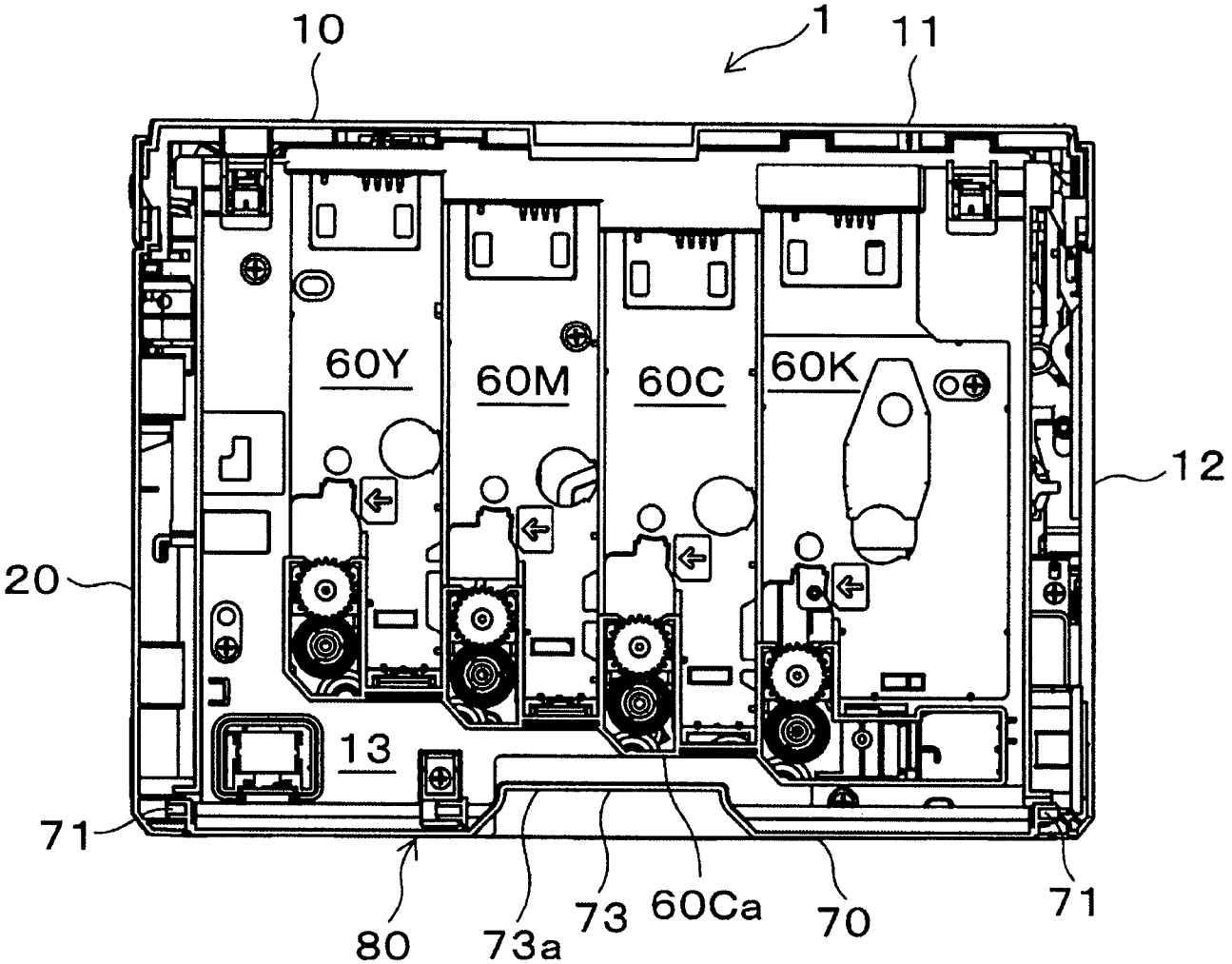
FIG. 4 is a side sectional view showing a hinge portion of the printer according to the exemplary embodiment.
Figure 7:
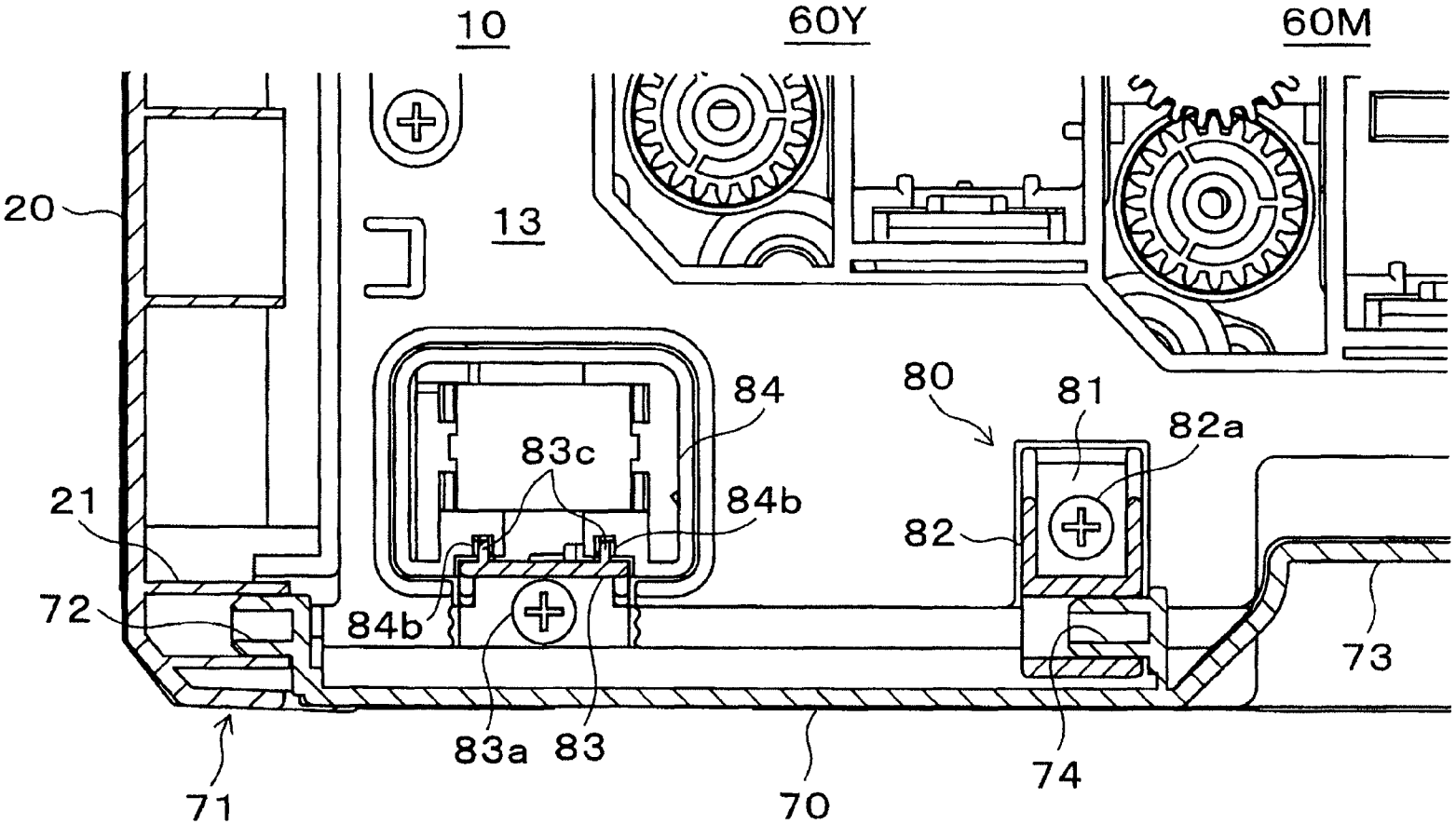
FIG. 7 is an enlarged side sectional view of a main portion in FIG. 4.

Opposite sides of a lower end portion of the side cover 70 are rotatably supported by first hinge mechanisms 71 (see FIGS. 4 and 7). As shown in FIG. 7, a cylindrical bearing 21 is formed in a lower end portion of the rear cover 20 so as to protrude from the right side. On the other hand, a shaft 72 is formed in the left lower end portion of the side cover 70 so as to be fitted to the bearing 21. A clearance (a gap which can be recognized by human sense) is provided between the bearing 21 and the shaft 72 so that the shaft 72 can move radially. Though not shown, another shaft 72 is formed in the right lower end portion of the side cover 70 in the same manner, and another bearing 21 is formed in a lower end portion of the front cover 12 in the same manner.

Figure 6:
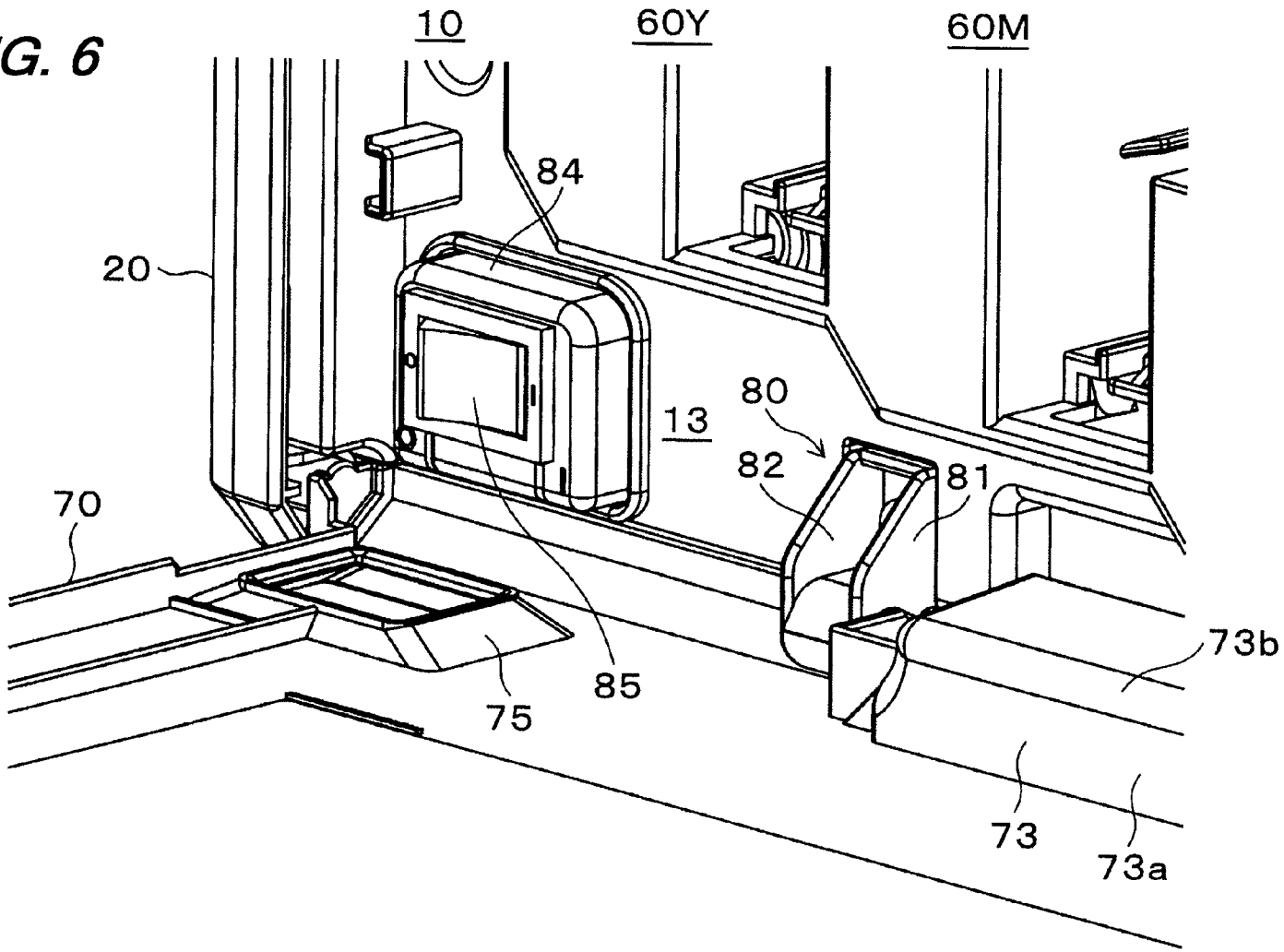
FIG. 6 is an enlarged perspective view showing a main portion in FIG. 2.

A handle portion 73 is formed in the center portion of the lower end of the side cover 70. The handle portion 73 is formed into a shape by denting a predetermined width portion of the side cover 70 in and above the center portion of the lower edge of the side cover 70 inwardly in the apparatus body 10. Thus, the handle portion 73 is formed as a concave portion which is open on its bottom and one side. The back of a top wall 73*a* of the handle portion 73 does not interfere with a low wall 60Ca of the toner cartridge receiving portion 60C when the side cover 70 is opened/closed (see FIG. 4). There is a small distance between the back of the top wall 73*a* and the low wall 60Ca when the side cover 70 is closed. In this manner, when the printer 1 is lifted with a hand supporting the handle portion 73, the side cover 70 is elastically deformed so that the low wall 60Ca can be supported by the back of the top wall 73*a* of the handle portion 73. As shown in FIG. 6, a corner portion 73*b* of the handle portion 73 along the top wall 73*a* of the handle portion 73 is formed into an arc in section. When the curvature radius of the corner portion 73*b* is increased, the distance between the low wall 60Ca of the toner cartridge receiving portion 60C and the back of the top wall 73*a* can be shortened.

Figure 8:
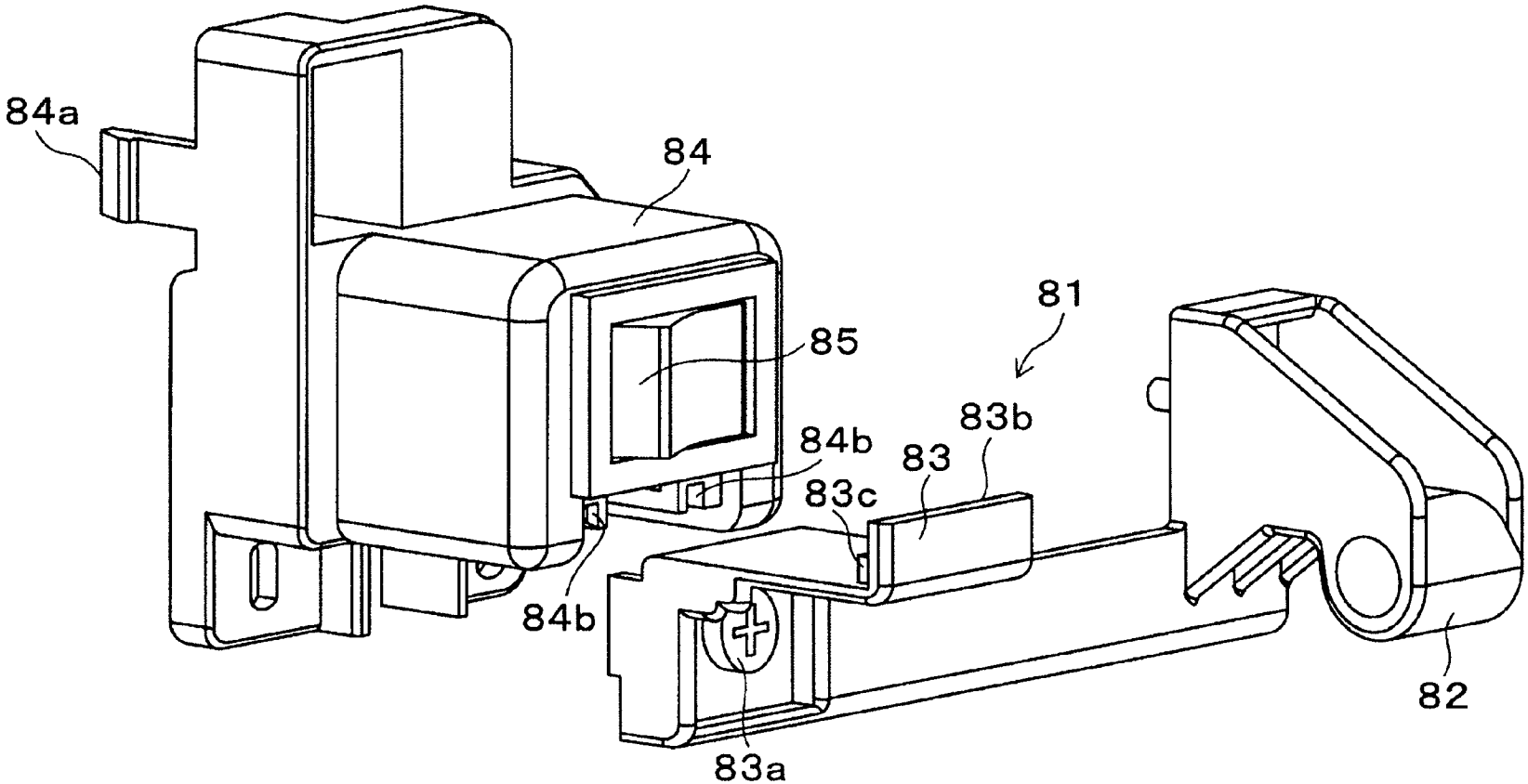
FIG. 8 is an enlarged perspective view showing a body-side hinge portion.

A second hinge mechanism 80 is provided in a side of the back of the handle portion 73. In FIG. 6, the reference numeral 81 represents a body-side hinge portion 81 of the second hinge mechanism 80. A bearing 82 is formed in a right end portion of the body-side hinge portion 81. Above the bearing 82, the body-side hinge portion 81 is attached to the apparatus body 10 by a screw 82*a*. In addition, as shown in FIG. 8, a stopper 83 which protrudes laterally and bends upward into an L-shape is formed in a left end portion of the body-side hinge portion 81. Under the stopper 83, the body-side hinge portion 81 is attached to the apparatus body 10 by a screw 83*a*.

On the other hand, a shaft (cover-side hinge portion) 74 which can be fitted to the bearing 82 is formed in the back side portion of the handle portion 73. In addition, a switch holder 84 is attached to the apparatus body 10. A hook 84*a* is formed in the switch holder 84. When the hook 84*a* is hooked on a hole provided in the apparatus body 10, the switch holder 84 is attached to the apparatus body 10. In FIG. 8, the reference numeral 85 represents a power switch, which is not shown in FIG. 7.

In FIGS. 6 and 7, the reference numeral 13 represents a partition (not shown in FIG. 8). The partition 13 prevents dust or the like from entering the inside of the apparatus body 10. The bearing 82 and a laterally protruding end portion of the switch holder 84 protrude from holes provided in the partition 13. In FIG. 6, the reference numeral 75 represents a window from which the power switch 85 is exposed.

As shown in FIG. 8, a portion of the switch holder 84 where wiring etc. for the power switch 85 are received is formed into a gate-like shape which is open on its bottom side, and slits 84*b* which are open laterally are formed in columnar portions of the gate-like shape. On the other hand, a protrusion 83*c* is formed in the stopper 83 of the body-side hinge portion 81. When the protrusion 83*c* is fitted to the slits 84*b*, the switch holder 84 can be prevented from being opened. In addition, an upward bent portion 83*b* of the stopper 83 is fitted to an opening portion of the lower end portion of the switch holder 84 to thereby prevent the switch holder 84 from being detached from the apparatus body 10.

(3) Operation of Side Cover Opening/Closing Mechanism

Next, in the aforementioned configuration of the side cover opening/closing mechanism, description will be made on the procedure for attaching the side cover 70 to the apparatus body 10. First, the rear cover 20 is attached to the apparatus body 10 in advance. The shafts 72 and 74 of the side cover 70 are made to face the bearings 21 and 82 of the apparatus body 10. In that state, the side cover 70 is shifted to the left to insert the shafts 72 and 74 into the bearings 21 and 82. Then, while the shaft 72 of the side cover 70 is inserted into the bearing 21 of the front cover 12, the front cover 12 is brought into tight contact with the apparatus body 10 and attached thereto.

Figure 5:
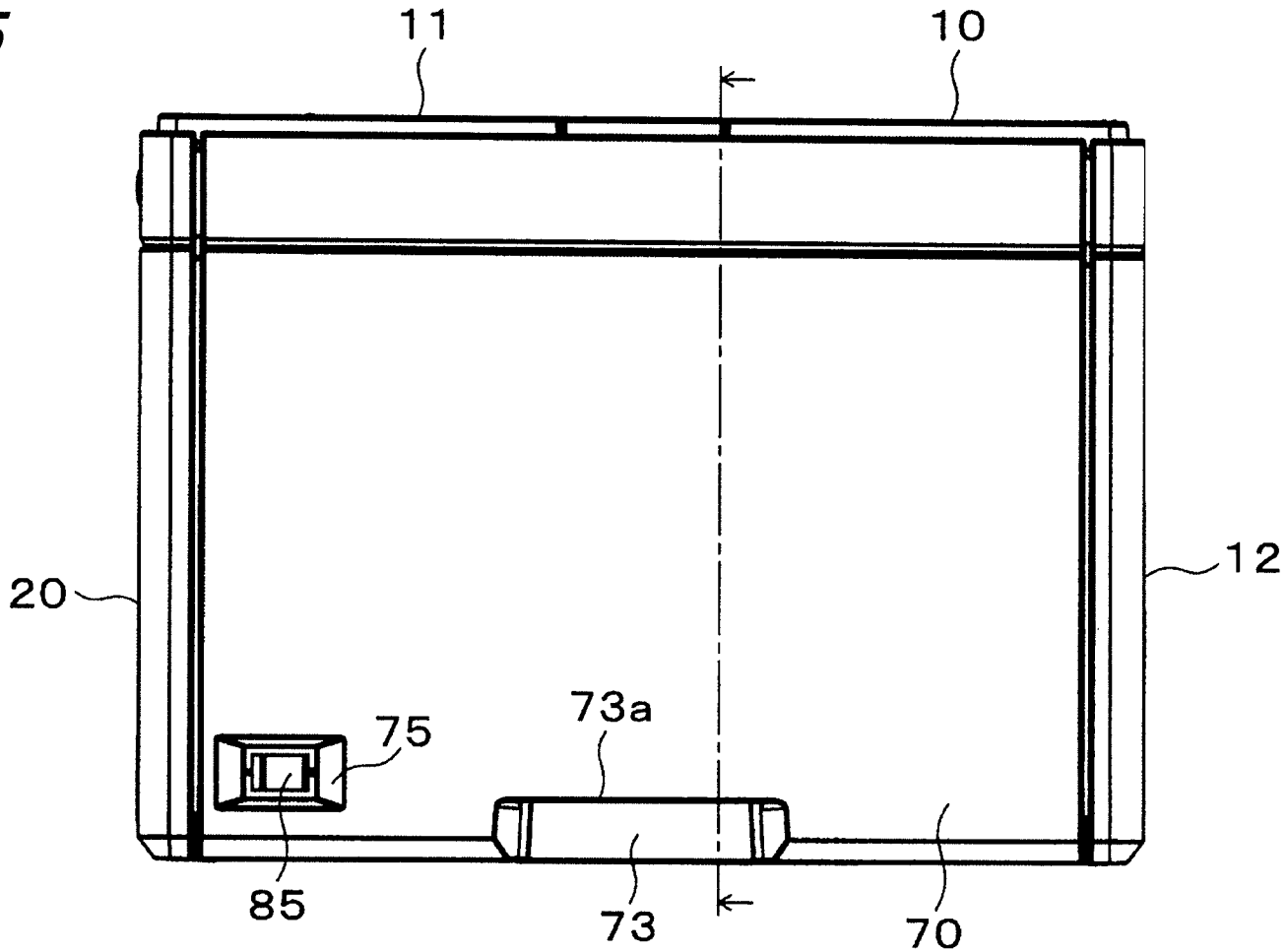
FIG. 5 is a side view showing the printer according to the exemplary embodiment.

Next, in order to move the printer 1, a hand is inserted into the handle portion 73 to lift up the printer 1 in the state where the side cover 70 has been closed as shown in FIG. 5. Then, a force applied to the handle portion 73 through the coupling between the shaft 74 and the bearing 82 in the second hinge mechanism 80 is transmitted to the apparatus body 10. In the initial stage where the handle portion 73 is lifted up, the clearance between the bearing 21 and the shaft 72 in the first hinge mechanism 71 prevents the force from being applied to the first hinge mechanism 71.

When the force is further applied to the handle portion 73, counterclockwise moment with the second hinge mechanism 80 as a fulcrum is generated in the side cover 70 because the second hinge mechanism 80 is located on the left side with respect to the center of the side cover 70. Thus, the side cover 70 intends to rotate counterclockwise. As a result, the bearing 21 of the front cover 12 and the shaft 72 of the side cover 70 comes into contact with each other, and the force is applied to the both. The side cover 70 is elastically deformed by the force. Due to this elastic deformation, the handle portion 73 moves up relatively to the second hinge mechanism 80, and the back of the top wall 73*a* of the handle portion 73 supports the low wall 60Ca of the toner cartridge receiving portion 60C. Thus, the force applied to the handle portion 73 is transmitted to the apparatus body 10 through the second hinge mechanism 80 and the low wall 60Ca of the toner cartridge receiving portion 60C so as to lift up the apparatus body 10.

According to the side cover opening/closing mechanism configured thus, the weight of the printer 1 is supported by the second hinge mechanism 80 and the low wall 60Ca of the toner cartridge receiving portion 60C before large elastic deformation occurs in the side cover 70. Accordingly, the elastic deformation of the side cover 70 is small, and the force acting on the first hinge mechanism 71 is small. Thus, the occurrence of such a case that the shaft 72 is detached from the bearing 21 in the first hinge mechanism 71 can be suppressed. Accordingly, it is possible to support the printer 1 by the handle portion 73 without increasing the rigidity or strength of the side cover 70.

Particularly according to the exemplary embodiment, the handle portion 73 is formed as a concave portion. Therefore, the handle portion 73 is prevented from protruding so that the printer 1 can be made compact. In addition, the weight of the printer 1 can be supported not only by the second hinge mechanism 80 but also by the low wall 60Ca of the toner cartridge receiving portion 60C. Thus, the load on the second hinge mechanism 80 is reduced so that the printer 1 can be supported surely.

In the aforementioned exemplary embodiment, the body-side hinge portion 81 is removably attached to the apparatus body 10 by the screws 82*a* and 83*a*. For example, even if the design of the printer 1 is changed so that the axial center positions of the bearings 21 of the front cover 12 and the rear cover 20 are changed, the body-side hinge portion 81 can be replaced to cope with the design change. In addition, since there is a clearance between the bearing 21 and the shaft 72 in the first hinge mechanism 71, the shaft 72 can be roughly inserted into the bearing 21 so that the workability in assembling can be improved.

In the aforementioned exemplary embodiment, the toner cartridge receiving portions 60Y, 60M, 60C and 60K are provided inside the side cover 70, and there is a space under the toner cartridge receiving portions 60Y, 60M, 60C and 60K as shown in FIG. 4. In the exemplary embodiment, the second hinge mechanism 80 and the handle portion 73 are received in such a space. Thus, the vacant space is effectively used so that the printer 1 can be miniaturized.

In addition, in the exemplary embodiment, when the switch holder 84 is attached to the apparatus body 10 by the hook 84*a* of the switch holder 84 through one-touch operation and the body-side hinge portion 81 is attached to the apparatus body 10, the switch holder 84 is fixed to the apparatus body 10 and prevented from being opened. Thus, the number of man hours in assembling components and the number of components can be reduced.

(4) Modifications

Although a clearance is provided between the bearing 21 and the shaft 72 in the aforementioned exemplary embodiment, the both may be brought into tight contact. In addition, the second hinge mechanism 80 may be provided on the right side of the back of the handle portion 73, or such second hinge mechanisms 80 may be provided on the opposite sides.

[Industrial Applicability]

The invention is applicable to an image forming apparatus such as a copying machine, a printer, a facsimile machine, a multifunctional machine having these functions, etc. In addition, the image forming apparatus may be of an inkjet type or of another type.

The foregoing description of the exemplary embodiment of the present invention has been provided for the purpose of illustration and description. It is not intended to be exhaustive or to limit the invention to the precise forms disclosed. Obviously, many modifications and various will be apparent to practitioners skilled in the art. The embodiments were chosen and described in order to best explain the principles of the invention and its practical application, thereby enabling other skilled in the art to understand the invention for various embodiments and with the various modifications as are suited to the particular use contemplated. It is intended that the scope of the invention be defined by the following claims and their equivalents.

What is claimed is:

1. A cover opening/closing unit comprising:

a cover body that is attached to a side surface of an apparatus body;

a plurality of first hinge portions that are provided on both ends of a lower end portion of the cover body so as to rotatably support the cover body;

a handle portion that is provided between the first hinge portions; and a second hinge portion that is provided on a back of the cover body and between the first hinge portions so as to rotatably support the cover body.

2. The cover opening/closing unit according to claim 1, wherein the handle portion is a concave portion which is dented inwardly in the apparatus body, and the second hinge portion is provided in a position at a side of the concave portion on the back of the cover body.

3. The cover opening/closing unit according to claim 2, wherein when the handle portion is lifted up with the cover body being closed, the cover body is elastically deformed to allow a back of the handle portion to support a part of the apparatus body from below.

4. The cover opening/closing unit according to claim 3, wherein the second hinge portion includes a body-side hinge portion provided in the apparatus body and a cover-side hinge portion provided in the cover body to operate with the body-side hinge portion so as to rotatably support the cover body, and the body-side hinge portion is removably attached to the apparatus body.

5. The cover opening/closing unit according to claim 2, wherein the second hinge portion includes a body-side hinge portion provided in the apparatus body and a cover-side hinge portion provided in the cover body to operate with the body-side hinge portion so as to rotatably support the cover body, and the body-side hinge portion is removably attached to the apparatus body.

6. The cover opening/closing unit according to claim 1, wherein when the handle portion is lifted up with the cover body being closed, the cover body is elastically deformed to allow a back of the handle portion to support a part of the apparatus body from below.

7. The cover opening/closing unit according to claim 6, wherein the second hinge portion includes a body-side hinge portion provided in the apparatus body and a cover-side hinge portion provided in the cover body to operate with the body-side hinge portion so as to rotatably support the cover body, and the body-side hinge portion is removably attached to the apparatus body.

8. The cover opening/closing unit according to claim 1, wherein the second hinge portion includes a body-side hinge portion provided in the apparatus body and a cover-side hinge portion provided in the cover body to operate with the body-side hinge portion so as to rotatably support the cover body, and the body-side hinge portion is removably attached to the apparatus body.

9. The cover opening/closing unit according to claim 1, wherein a clearance is provided in a shaft portion of the first hinge portions so that when the handle portion is lifted up with the cover body being closed, a load of the apparatus body is first applied to the second hinge portions, and the load of the apparatus body is then applied to the first hinge portions.

10. The cover opening/closing unit according to claim 1, wherein a removably mounting portion for a consumable component is provided in a side surface of the apparatus body, and the cover body is provided on the side surface.

11. An image forming apparatus comprising:

an image forming portion that forms an image with a developing agent, wherein the image forming portion includes a cover opening/closing unit including:

a cover body that is attached to a side surface of an apparatus body;

a plurality of first hinge portions that are provided on both ends of a lower end portion of the cover body so as to rotatably support the cover body;

a handle portion that is provided between the first hinge portions; and a second hinge portion that is provided on a back of the cover body and between the first hinge portions so as to rotatably support the cover body.

* * * * *